US005265580A

United States Patent [19]

Vogel et al.

[11] Patent Number: 5,265,580

[45] Date of Patent: Nov. 30, 1993

[54] DOUBLE COIL IGNITION SYSTEM FOR AN INTERNAL COMBUSTION ENGINE

[75] Inventors: Manfred Vogel, Ditzingen; Werner Herden, Gerlingen, both of Fed. Rep. of Germany

[73] Assignee: Robert Bosch GmbH, Stuttgart, Fed. Rep. of Germany

[21] Appl. No.: 934,735

[22] PCT Filed: May 27, 1991

[86] PCT No.: PCT/DE91/00444

§ 371 Date: Sep. 30, 1992

§ 102(e) Date: Sep. 30, 1992

[87] PCT Pub. No.: WO92/00454

PCT Pub. Date: Jan. 9, 1992

[30] Foreign Application Priority Data

Jun. 23, 1990 [DE] Fed. Rep. of Germany ..... 4020103

[51] Int. Cl.[5] ..... F02P 3/12

[52] U.S. Cl. ..... 123/655; 123/620

[58] Field of Search ..... 123/655, 620, 621, 643

[56] References Cited

U.S. PATENT DOCUMENTS

| | | | |
|---|---|---|---|
| 4,361,129 | 11/1982 | Sugio et al. | 123/622 |
| 4,411,247 | 10/1983 | Kunita et al. | 123/655 |
| 4,463,744 | 8/1984 | Tanaka et al. | 123/643 |
| 4,556,040 | 12/1985 | Hoyke | 123/655 |
| 5,044,348 | 9/1991 | Ookawa | 123/637 |
| 5,044,349 | 9/1991 | Benedikt et al. | 123/655 |

FOREIGN PATENT DOCUMENTS

| | | | |
|---|---|---|---|
| 3737781 | 5/1988 | Fed. Rep. of Germany | 123/655 |
| 2064227 | 6/1981 | United Kingdom | 123/655 |

*Primary Examiner*—Raymond A. Nelli

*Attorney, Agent, or Firm*—Michael J. Striker

[57] ABSTRACT

The ignition system for an internal combustion engine includes an ignition coil having a primary coil and a secondary coil; a plurality of semiconductor switching elements connected with the secondary coil which change abruptly from a blocking state to a conducting state at a predetermined breakdown voltage corresponding to an ignition voltage, each of the semiconductor switching elements including at least one breakdown diode; an ignition line connected electrically to a higher voltage end of the secondary coil and another ignition line connected electrically to a lower voltage end of the secondary coil, each of the ignition lines being connected via one of the semiconductor switching elements to a spark plug and being of different length, wherein the semiconductor switching element in the one line has a different breakdown voltage than the semiconductor switching element in the other line. Advantageously the shorter ignition line contains the semiconductor switching element with the higher breakdown voltage so that an increased steepening effect can be achieved for the ignition voltages applied to the spark plugs.

5 Claims, 1 Drawing Sheet

DOUBLE COIL IGNITION SYSTEM FOR AN INTERNAL COMBUSTION ENGINE

BACKGROUND OF THE INVENTION

The present invention relates to a high voltage switch, and, more particularly, to a high voltage switch for use in a double-coil ignition system.

The invention is based on an ignition system e.g. as is known from DE-OS 37 31 393. High-voltage switches which are arranged on the secondary side, preferably in the spark plug terminal, are used in the above-mentioned ignition system. State-charging or breakdown diode cascades are used as high-voltage switching elements. Ten to fifty diodes are stacked one on top of the other depending on the electric strength of an individual diode and depending on the desired breakdown voltage. This kind of high-voltage switch which changes suddenly from the blocking state to the conducting state makes it possible to eliminate the influences of shunts at the spark plug. Because of their self-capacitance, long ignition lines following the breakdown diode have disadvantageous effects on the steepening effect of the breakdown diode. For this reason the high-voltage switch is preferably arranged in the spark plug terminal. When such semiconductor switching elements are used with double ignition coils, the breakdown voltage must be kept low enough so that it is achieved in every case because of the division of voltage on the secondary side. However, this has the disadvantage that there is hardly any steepening effect when the breakdown voltage clearly lies below 11 kV.

The present solution endeavors to find a favorable size of the breakdown voltage with respect to the greatest possible steepening effect for optimum use of the high-voltage switch.

SUMMARY OF THE INVENTION

It is an object of the present invention to provide an improved double-coil ignition system having none of the above-described disadvantages.

This object and others which will be made more apparent hereinafter is attained in an ignition system for an internal combustion engine with semiconductor switching elements arranged in a secondary circuit of this ignition system, each semiconductor switching element comprising at least one breakdown diode connected so that the semiconductor switching element abruptly changes from the blocking state to the conducting state on application of a predetermined breakdown voltage.

According to the invention, the ignition system has a double ignition coil comprising a primary coil and a secondary coil, the secondary coil having a higher voltage end and a lower voltage end, an ignition line connected electrically to the higher voltage end of the secondary coil and another ignition line connected electrically to the lower voltage end of the secondary coil, said ignition lines containing the semiconductor switching elements and having different lengths, wherein the semiconductor switching element in the one line has a different breakdown voltage than that of the semiconductor switching element in the other line.

Advantageously the semiconductor switching element with the higher breakdown voltage is assigned to the shorter ignition line. The semiconductor switching element can have a plurality of breakdown diodes connected to form a breakdown diode cascade.

The solution, according to the invention, has the advantage that with the use of breakdown or state-changing diode cascades in ignition systems with double ignition coils the high-voltage switch is dimensioned in such a way with respect to its breakdown voltage that the effect of the capacitance of the ignition lines prior to the high-voltage switches is used in such a way that a breakdown diode with a higher breakdown voltage can be arranged in the shorter ignition line. The steepening effect at the corresponding spark plug is accordingly increased relative to the high-voltage switches with the same breakdown voltage. The breakdown voltage of the two semiconductor switching elements is approximately between 11 kV and 20 kV.

When five-layer elements of symmetrical construction which change state in both voltage directions are used as individual breakdown diodes in a cascade, the polarity of the high-voltage switch need not be taken into consideration in contrast to conventional breakdown diodes (four-layer diodes). This fact brings about advantages when refitting with breakdown diodes and facilitates repair, e.g. when exchanging the spark plug terminal, since exchanges can be effected without taking the polarity into account.

BRIEF DESCRIPTION OF THE DRAWING

An embodiment example of the invention is shown in the drawing and explained in more detail in the following description.

DESCRIPTION OF THE PREFERRED EMBODIMENTS

In the following, the use of the high-voltage switch is described in an ignition system of a motor vehicle.

Figure 1:
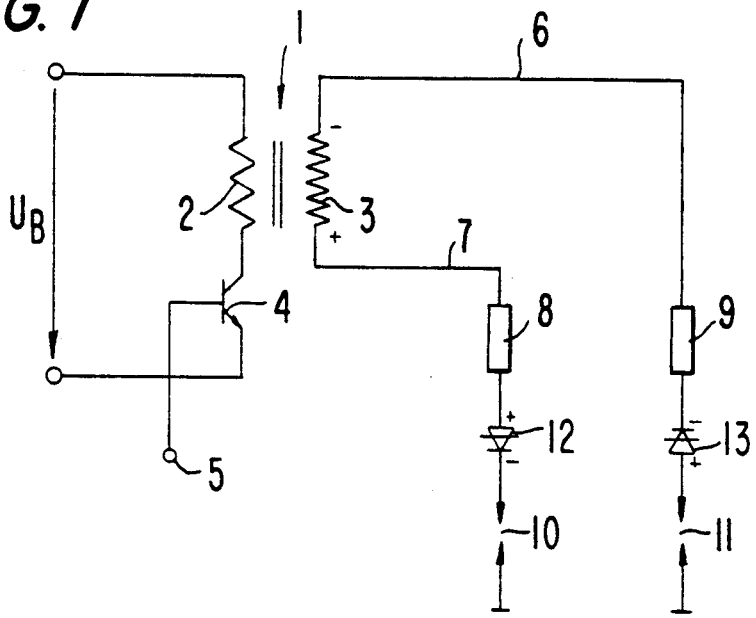
FIG. 1 is a basic circuit diagram of an ignition system with double ignition coils.

FIG. 1 shows an ignition system with a double ignition coil 1 whose primary winding 2 is connected to a power supply UB, e.g. to the battery of a motor vehicle, not shown, via an ignition transistor 4. The ignition transistor 4 is driven in a known manner by a control device via a control terminal 5. The secondary winding 3 is connected on one side via an ignition line 6 with a suppressor resistor 9, a high-voltage breakdown diode 13, and a spark plug 11 and on the other side with reverse polarity via an ignition line 7 with a suppressor resistor 8 and a high-voltage breakdown diode 12, likewise of opposite polarity, with a spark plug 10.

Figure 2A:
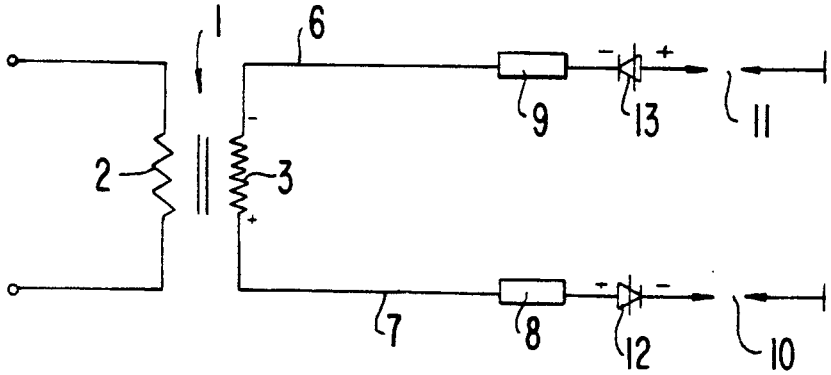
FIG. 2*a* is the secondary side of an ignition system of a double ignition coil with breakdown diodes with asymmetric characteristic line.
Figure 2B:
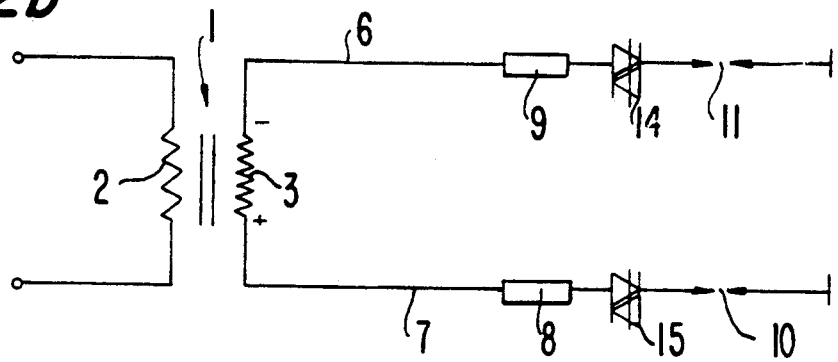
FIG. 2*b* is a circuit diagram of the secondary side of an ignition system of a double ignition coil with breakdown diodes with symmetrical characteristic line.

FIGS. 2*a* and 2*b* show an ignition system with the double ignition coil 1 which is connected with the spark plugs 10 and 11 via its ignition lines 6, 7 the suppressor resistors 8, 9 and either via high-voltage breakdown diodes 12 and 13, as in FIG. 2*a*, or via the symmetrical high-voltage breakdown diodes 14 and 15 as in FIG. 2*b*.

The ignition system shown in FIG. 1 works in the following manner. By turning off the current flowing through the primary winding 2 of the double ignition coil 1 by means of the ignition transistor 4, a voltage U is induced in the secondary winding 3 which is e.g. approximately 30 kV and, when the breakdown voltage predetermined by the high-voltage breakdown diodes 12 and 13 is achieved, the ignition lines 6 and 7 become conducting the spark plugs 10 and 11, which leads to the triggering of the ignition spark either immediately or after a further increase in voltage. As a result of the circuit shown in FIG. 1 with the use of double ignition coils, the ignition voltage supplied by the ignition coil on the secondary side is divided at the two ignition lines 6 and 7, i.e. the breakdown voltage of the breakdown diodes 12 and 13 must be kept low so as to ensure a switching-through of the ignition voltage at the spark plugs 10 and 11. However, the actually desired steepening effect of the breakdown diodes 12 and 13 is no longer effective at a breakdown voltage of less than 11 kV. The effect of the self-capacitances of the ignition lines 6 and 7 of different length is now used. These capacitances are charged as long as the breakdown diodes 12 and 13 are in the blocking state. The voltage on the secondary side of the ignition coil is accordingly distributed in a nonuniform manner to the ignition lines 6 and 7. Since the shorter ignition line 7 has a lower capacitance, and accordingly a higher voltage than that of the longer ignition line 6 to which the lower voltage is applied, the breakover voltage at the breakdown diode 12 can be higher and a better steepening effect can be ensured. In the described ignition system, the breakdown voltages of the breakdown diode can be selected in such a way that the breakdown diode 13 in the longer ignition line 6 changes state at approximately 11 to 13 kV and the breakdown diode 12 in the shorter ignition line 7 changes state at approximately 16 to 18 kV.

FIGS. 1 and 2*a* show a circuit of the secondary side 3 of an ignition system with double ignition coils with breakdown diodes as four-layer diodes with an asymmetrical characteristic line. The polarity of the high-voltage breakdown diodes must be taken into account during installation in this case, i.e. the side of the ignition coil with positive potential must be associated with the anode of the breakdown diode and the side of the ignition coil with negative potential must be associated with the cathode of the breakdown diodes.

If breakdown diodes with a symmetrical characteristic line are used as shown in FIG. 2*b*, the polarity of the breakdown diode cascades need not be taken into account when installing or, if necessary, exchanging the spark plug or spark plug terminal, since the latter change state in both voltage directions due to their symmetrical characteristic line.

While the invention has been illustrated and embodied in a double coil ignition system for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

1. Ignition system for an internal combustion engine comprising:

a double coil including a primary coil and a secondary coil, the secondary coil having a higher voltage end and a lower voltage end;

a plurality of semiconductor switching elements connected with the secondary coil, each of said semiconductor switching elements changing abruptly from a blocking state of a conducting state at a predetermined breakdown voltage, each of said semiconductor switching elements including at least one breakdown diode;

an ignition line connected electrically to the higher voltage end of the secondary coil and another ignition line connected electrically to the lower voltage end of the secondary coil, said ignition lines being connected via the semiconductor switching elements to spark plugs and having different lengths, wherein the breakdown voltage of the semiconductor switching element in the one ignition line is different from the breakdown voltage of the semiconductor switching element in the other ignition line.

2. Ignition system as defined in claim 1, wherein the breakdown voltage of each of the semiconductor switching elements is between 11 kV and 20 kV.

3. Ignition system as defined in claim 1, wherein the ignition line having a shorter length contains the semiconductor switching element with a higher breakdown voltage so that an increased steepening effect can be attained at the spark plugs.

4. Ignition system as defined in claim 1, wherein each of the breakdown diodes is a five-layer semiconductor element of symmetrical structure and changes conduction state in both voltage directions.

5. Ignition system as defined in claim 1, wherein each of the semiconductor switching elements contain a plurality of the breakdown diodes connected in a breakdown diode cascade.

* * * * *